US007207414B2

(12) United States Patent
Luke et al.

(10) Patent No.: US 7,207,414 B2
(45) Date of Patent: Apr. 24, 2007

(54) SUPPORTING BRACKET ASSEMBLY FOR A HORIZONTAL LIFELINE CABLE

(75) Inventors: Michael Luke, Blackwell (GB); Simon Luke, Solihull (GB)

(73) Assignee: Uniline Safety Systems Limited (GB)

( * ) Notice: Subject to any disclaimer, the term of this patent is extended or adjusted under 35 U.S.C. 154(b) by 178 days.

(21) Appl. No.: 10/433,932

(22) PCT Filed: Nov. 26, 2001

(86) PCT No.: PCT/GB01/05206

§ 371 (c)(1),
(2), (4) Date: Oct. 24, 2003

(87) PCT Pub. No.: WO02/43809

PCT Pub. Date: Jun. 6, 2002

(65) Prior Publication Data

US 2004/0050620 A1 Mar. 18, 2004

(30) Foreign Application Priority Data

Nov. 29, 2000 (GB) ..... 0029047.8

(51) Int. Cl.
*A62B 35/00* (2006.01)
*E04G 21/00* (2006.01)

(52) U.S. Cl. ..... 182/3; 182/45

(58) Field of Classification Search ..... 182/3, 182/36, 45, 113; 104/115; 52/736.1, 704
See application file for complete search history.

(56) References Cited

U.S. PATENT DOCUMENTS

| | | | | |
|---|---|---|---|---|
| 498,351 | A * | 5/1893 | Kasper | 119/789 |
| 4,607,724 | A | 8/1986 | Hillberg | |
| 5,398,777 | A * | 3/1995 | Ouellette et al. | 182/3 |
| 6,260,661 | B1 * | 7/2001 | Cutter et al. | 182/45 |
| 6,330,861 | B1 * | 12/2001 | Flux | 104/115 |
| 6,478,111 | B2 * | 11/2002 | Olson et al. | 182/3 |
| 6,763,910 | B2 * | 7/2004 | Cole | 182/3 |
| 6,786,020 | B2 * | 9/2004 | Poldmaa | 52/704 |

FOREIGN PATENT DOCUMENTS

| | | |
|---|---|---|
| EP | 834627 A1 * | 4/1998 |
| GB | 2330169 | 4/1999 |
| WO | WO9951304 | 10/1999 |

* cited by examiner

*Primary Examiner*—Alvin Chin-Shue
(74) *Attorney, Agent, or Firm*—Ira S. Dorman

(57) ABSTRACT

A supporting bracket assembly for a horizontal lifeline cable (4) comprises a base plate (14), bracket means (24) and holding means (28) for the cable. The base plate (14) is provided for securing to a structure (6). The bracket means (24) is secured to the base plate and adapted for frictionally restrained pivotability with respect to the base plate and the holding means (28) for the cable (4) is secured to the bracket means (24). In this way, dynamic loading of the cable (4) results in pivoting of the bracket means (24), against frictional restraint, from a first position (36) into a second position (38).

30 Claims, 5 Drawing Sheets

SUPPORTING BRACKET ASSEMBLY FOR A HORIZONTAL LIFELINE CABLE

The present invention relates to horizontal lifeline cables for use with structures such as buildings, and more particularly to a supporting bracket assembly suitable for fixing to a roof top of a building for securing an end of a horizontal lifeline cable and/or for supporting a horizontal lifeline cable intermediate ends thereof.

U.S. Pat. No. 4,607,724 describes a safety device for preventing workers from falling off a peaked roof and which includes a boom pivotally connected to a rotatable stanchion. The rotatable stanchion is supported on the roof by a saddle which is adjustable to permit it to be mounted on various peaked roofs having different slopes. A tether is connected at one end for slidable movement along the boom and is connectable at the other end to the back of a worker's safety belt or harness in order to arrest movement or catch the worker in the event of a slip or fall. The rotatable stanchion and slidable tether give the worker a high degree of mobility on the roof and without interference with work or materials on the roof. A brake operable by tension in the tether arrests rapid sliding of the tether along the boom and a pair of shock absorber devices are provided to assist the brake in reducing any jolt if a falling worker is caught by the safety device.

Horizontal lifeline cables are known to be installed at high levels on structures such as buildings and arranged to provide protection against falling for people working on such structures. Such people generally wear a harness to which one end of a safety line is secured, the other end of the line being slidably secured, by means of an attachment device, to the horizontal lifeline cable.

It is necessary to provide brackets secured to the structure and to which ends of the cable are connected. It is also necessary to provide intermediate brackets secured to the structure for supporting the cable at locations intermediate the ends thereof.

It is known to install such brackets on the top of roofs of buildings. However, in order to install such brackets to roofs it is necessary to damage the roof in order to secure the bracket to the structure of the building. The damage can be in the form of holes of considerable diameter in the roof structure to pass through brackets to which the ends of the cable are connected or to which intermediate brackets are connected.

In addition, damage can occur to a roof structure when a person working on a building accidentally falls and a dynamic load is applied to the horizontal lifeline cable and this load is transmitted to the one or more brackets secured to the roof and supporting the cable.

It is an object of the present invention to overcome or minimise these problems.

According to the present invention there is provided a supporting bracket assembly for a horizontal lifeline cable, the assembly comprising: a base plate for securing to a structure; bracket means secured to the base plate and adapted for frictionally restrained pivotability with respect to the base plate; and holding means for the cable secured to the bracket means, wherein the holding means is secured to the bracket means by way of a spring-loaded mechanism, the arrangement being such that dynamic loading of the cable results in pivoting of the bracket means, against frictional restraint, from a first position into a second position and, in the second position, tensions the holding means for the cable against spring force of the spring-loaded mechanism.

The holding means for the cable may be secured to the bracket means by means of an assembly of a nut and bolt and a compression spring.

The bracket means may be substantially upstanding on the base plate in the first position and substantially laterally disposed with respect to the base plate in the second position.

The base plate may be provided with a transverse cross member underlying the bracket means.

The bracket means may be disposed in contact with the cross member in the second position.

The base plate may be provided with a pair of upstanding lugs to which the bracket means is secured.

The bracket means may be secured to the base plate by means of a pair of nut and bolt assemblies incorporating one or more friction washers.

The holding means for the cable may be an end bracket to which is securable an end of the cable.

Alternatively the holding means for the cable may be an intermediate bracket assembly for supporting the cable intermediate ends of the cable.

Such intermediate bracket assembly may incorporate dynamic load absorbing means and may comprise: base means secured to the bracket means; arm means having a first end thereof provided with means for pivotably securing it to the base means and a second end thereof adapted to receive the cable; at least one shear pin secured to the base means and arranged to support the arm means at a region thereof intermediate the first and second ends thereof and in a first angular disposition relative to the base means, the at least one shear pin being adapted to shear when the supporting bracket assembly is secured to the structure and a predetermined downwardly-directed load is applied directly or indirectly to the cable at or near the second end of the arm means, whereby the arm means pivots downwardly about the first end thereof and assumes a second angular disposition relative to the base means.

The at least one shear pin may be secured to the base means at a selected one of a plurality of positions whereby the first angular disposition of the arm means relative to the base means may be varied.

The base means may be of substantially U-shaped form having a base portion arranged to be secured to the bracket means and a pair of spaced-apart flange portions dependant therefrom, the first end of the arm means being pivotably secured to the flange portions and the shear pin being secured at a predetermined position between the flange portions.

The flange portions may be provided with at least one pair of opposed cooperating apertures for securably receiving the at least one shear pin.

The flange portions may be provided with a pair of opposed cooperating apertures which receive the means for pivotably securing the first end of the arm means thereto.

The at least one shear pin may comprise a plastics material, such as nylon.

The at least one shear pin may be in the form of a threaded bolt provided with a threaded nut.

The first end of the arm means may be pivotably secured to the base means by means of a pin or bolt, which may be of stainless steel. Such bolt may be threaded and provided with a threaded nut. The first end of the arm means may be provided with a first hollow substantially cylindrical component through which the pin or bolt passes.

The second end of the arm means may be provided with a second hollow substantially cylindrical component through which the cable is arranged to pass. Such second substantially cylindrical component may be externally tapered at opposite ends thereof, such as to facilitate traversal of the intermediate bracket assembly by an attachment device which may be slidably secured to the cable and connected to a safety line extending from a person working on the structure.

The arm means may be provided, at the region intermediate the first and second ends thereof, with a third hollow substantially cylindrical component through which the shear pin is arranged to pass.

The arm means may be of plate form which may be substantially rectangular.

The cable may comprise stainless steel wires, or synthetic plastics fibres which may be in the form of a bundle which may be enclosed in a jacket, such as of neoprene.

The structure may be a building and particularly a roof of a building.

The supporting bracket assembly of the invention minimises or reduces risk of damage to a structure, such as a roof top of a building, to which it is secured, when a dynamic load is applied to a horizontal lifeline cable secured thereto or supported thereby. When the load is applied, the bracket means secured to the base plate pivots against its frictional restraint, from its first position to its second position, resulting in initial absorption of the load. When the bracket means reaches its second position, the load is further absorbed by the spring-loaded mechanism. Provision of the cross member on the base plate, underlying the bracket means, further reduces risk of damage to the roof structure since the bracket means contacts the cross member when it pivots into its second position.

If the intermediate bracket assembly incorporating a shear pin is provided, this results in further absorption of the applied dynamic load and further reduces risk of damage to the roof structure.

For a better understanding of the invention and to show more clearly how it may be carried into effect, reference will now be made, by way of example, to the accompanying drawings in which.

Figure 1:
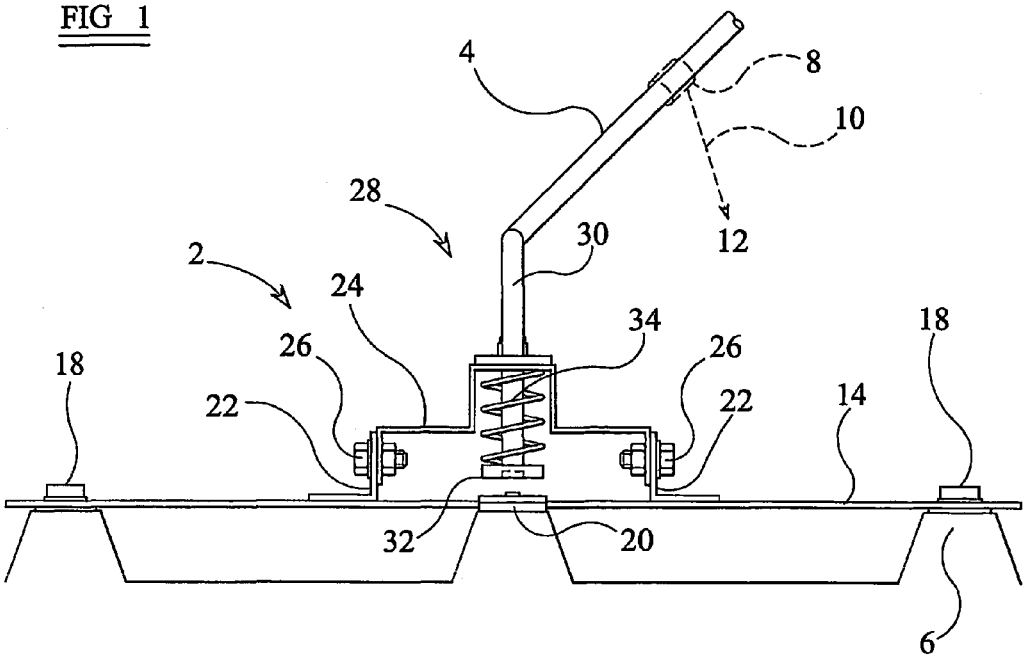
FIG. 1 is a rear view of an embodiment of a supporting bracket assembly according to the present invention, incorporating an end bracket secured to the end of a horizontal lifeline cable.
Figure 2:
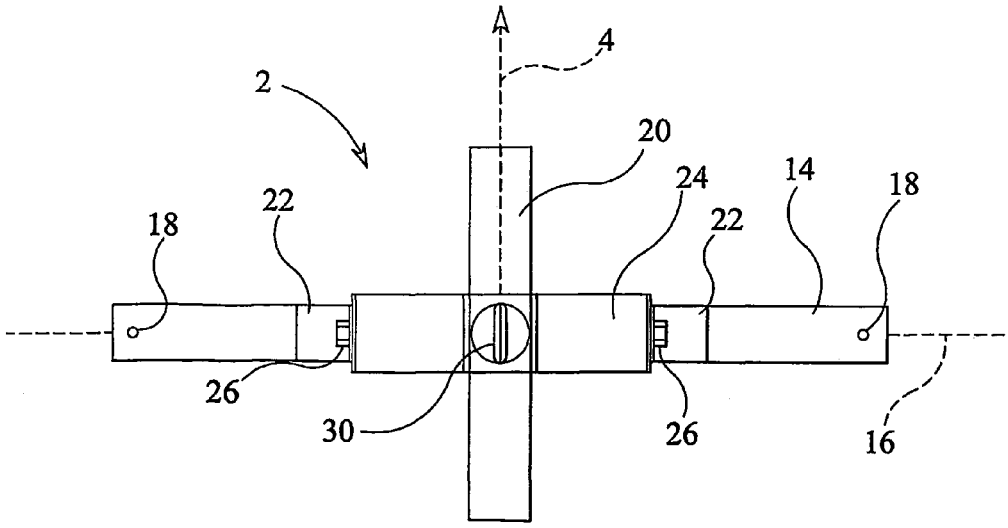
FIG. 2 is a top view of the assembly of FIG. 1, showing bracket means thereof in a first position.

Referring to FIGS. 1 and 2, a supporting bracket assembly 2 is provided for securing an end of a horizontal lifeline cable 4 to the top of a roof 6 of a building.

The cable 4 can comprise stainless steel wires, but advantageously comprises a bundle of synthetic plastics fibres, such as polyester fibres, suitably enclosed in a jacket, such as of neoprene.

An attachment device 8 is arranged to slide along the cable 4 and has one end of a safety line 10 secured thereto. The other end of the safety line is secured by means of a suitable harness (not shown), of well-known form, to a person 12 who may be working on the building and is to be protected from falling from the building.

The supporting bracket assembly 2 has an elongate base plate 14 of strap form and suitably comprising stainless steel. The base plate 14 is secured to the top of the roof 6, along the line of roof purlins. 16, by means of bolts 18. As particularly shown in FIG. 2, a transverse cross member 20 is provided on the base plate 14 and either secured to or integral with the base plate 14. Such cross member 20 is also of strap form and suitably comprises stainless steel.

The base plate 14 is provided with a pair of upstanding apertured lugs 22 to which an apertured formed bracket means 24, suitably of stainless steel, is attached by means of nut, bolt and friction washer assemblies 26. The bracket means 24 is arranged for frictionally restrained pivotability with respect to the base plate 14 by means of the nut, bolt and friction washer assemblies 26. If desired, the orientation of the base plate and cross member can be interchanged such that the cross member runs along the line of roof purlins, or lugs 22 may additionally or alternatively be provided on the cross member, to allow the cable to change direction on the roof.

A holding means 28 is provided for the cable 4. Such holding means 28 comprises an end anchorage connector 30 to which is secured the end of the cable 4. The end anchorage connector. 30 is secured to the formed bracket means 24 by means of a spring-loaded mechanism comprising a bolt 32 with a nut, and a compression spring 34.

Figure 3:
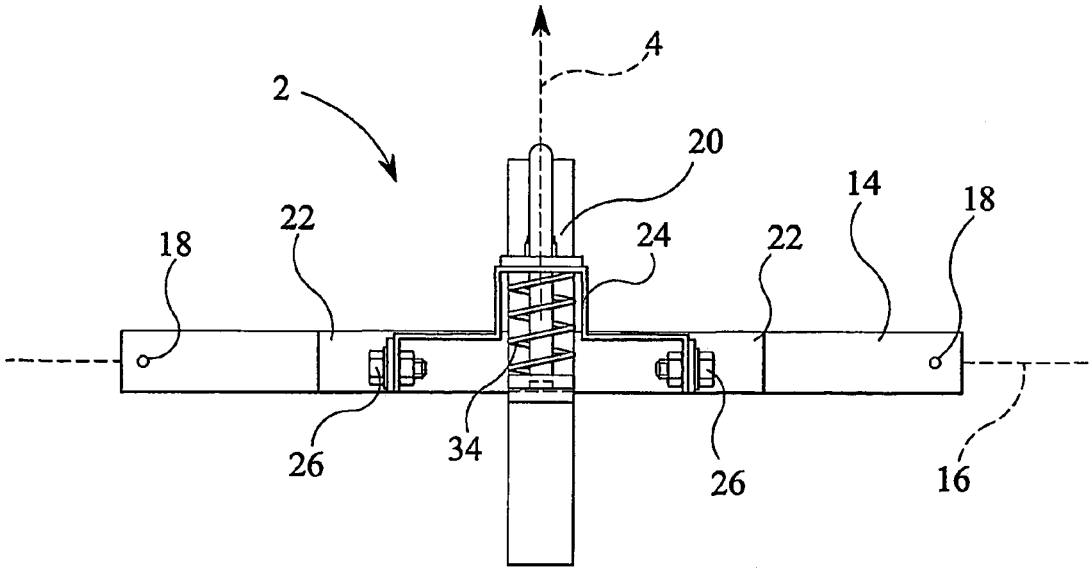
FIG. 3 is a top view of the assembly of FIG. 1, showing the bracket means thereof pivoted into a second position.
Figure 4:
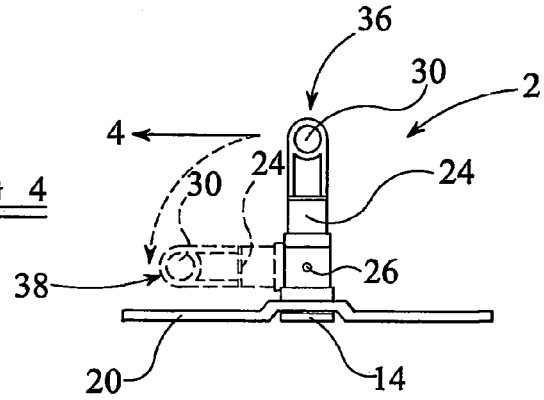
FIG. 4 is a side view of the assembly of FIG. 1, illustrating pivoting of the bracket means thereof from the first position to the second position.
Figure 5:
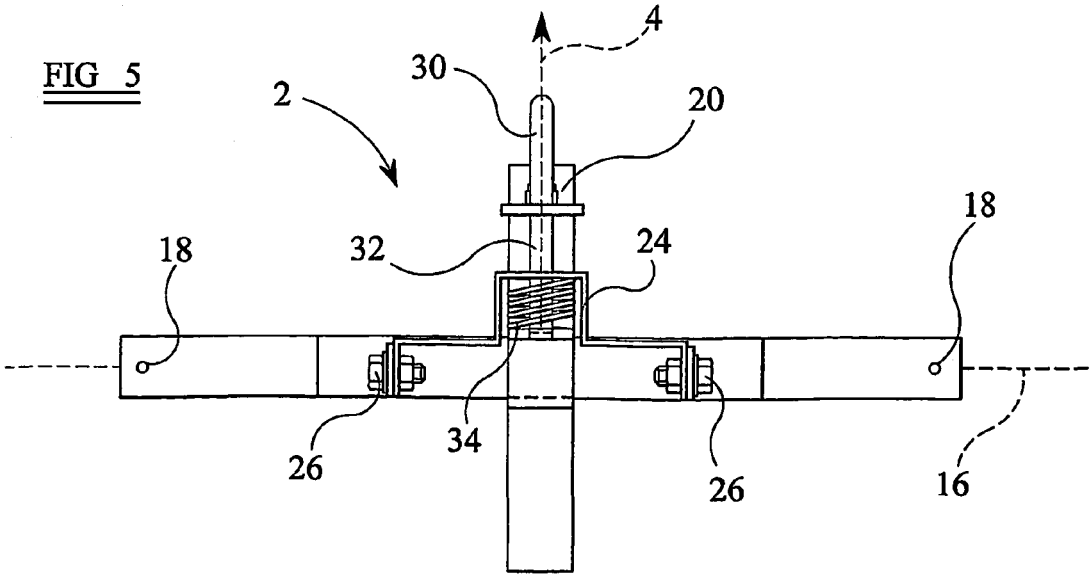
FIG. 5 is a top view of the assembly of FIG. 1, showing the bracket means thereof pivoted into the second position of FIG. 3 and with a spring in a spring-loaded mechanism compressed.

The friction in the nut, bolt and friction washer assemblies 26 is arranged such that with the horizontal lifeline cable 4 installed in a pretensioned state on the building, the bracket means 24 is located in an upstanding first position 36 as shown in FIG. 4 and also as illustrated in FIGS. 1 and 2. If an accident occurs such that the person 12 slips when secured by the safety line 10 to the cable 4, a dynamic load is exerted on the cable 4 and is applied to the end anchorage connector 30. Such dynamic load overcomes the frictional restraint of the nut, bolt and friction washer assemblies 26. As a result the bracket means 24 pivots on the bolts of the nut, bolt and friction washer assemblies 26 and falls into a second position 38, in contact with the cross member 20, as shown in FIG. 4 and also as illustrated in FIG. 3. Furthermore, when in this second position 38, the applied load, which is a tensile load, results in compression of the spring 34 of the spring-loaded mechanism, as shown in FIG. 5.

The pivoting of the bracket means 24 against its frictional restraint results in initial absorption of the dynamic load while the residual dynamic load is absorbed by the compression of the spring 34. This minimises risk of damage to the structure of the roof 6 resulting from the dynamic load. The provision of the cross member 20 onto which the bracket means 24 falls, prevents damage to the fabric of the roof.

Figure 6:
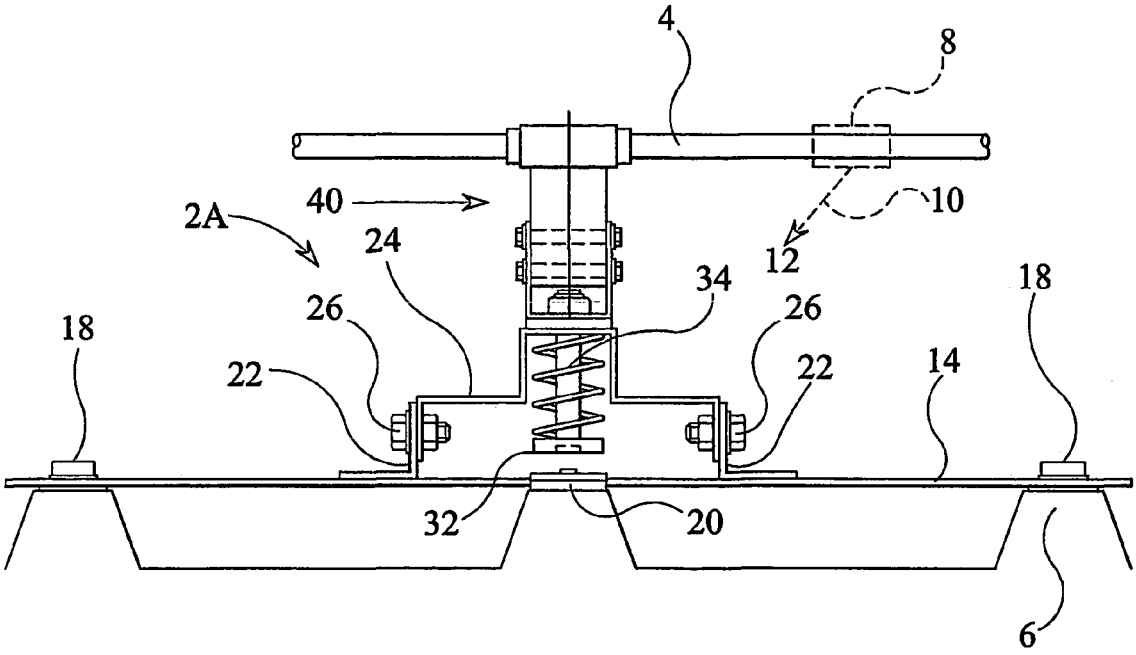
FIG. 6 is a rear view of an embodiment of a supporting bracket assembly according to the present invention, incorporating an intermediate bracket assembly supporting a horizontal lifeline cable intermediate ends thereof.

FIG. 6 shows a supporting bracket assembly 2A which differs from the assembly 2 of FIG. 1 in that, instead of the holding means 28 of FIG. 1 in the form of an end anchorage connector 30 for the end of the cable 4, a holding means is provided comprising an intermediate bracket assembly 40. The intermediate bracket assembly 40 is secured to the bracket means 24 by means of the spring loaded mechanism comprising the nut and bolt assembly 32 and compression spring 34 and is arranged to support the horizontal lifeline cable 4 at a position intermediate the ends of the cable 4.

Operation of the bracket assembly 2A is basically the same as that of the bracket assembly 2 of FIG. 1. When a dynamic load is exerted on the cable 4 as a result of a person 12 slipping when secured thereto by a safety line 10, such load is applied to the intermediate bracket assembly 40 and overcomes the frictional restraint of the nut, bolt and friction washer assemblies 26. As a result, the bracket means 24 pivots on the bolts of the nut, bolt and friction washer assemblies 26 and falls into a position in contact with the cross member 20, resulting in some absorption of the dynamic load. The residual load, which is exerted in tensile manner, is then absorbed by compression of the spring 34.

Figure 7:
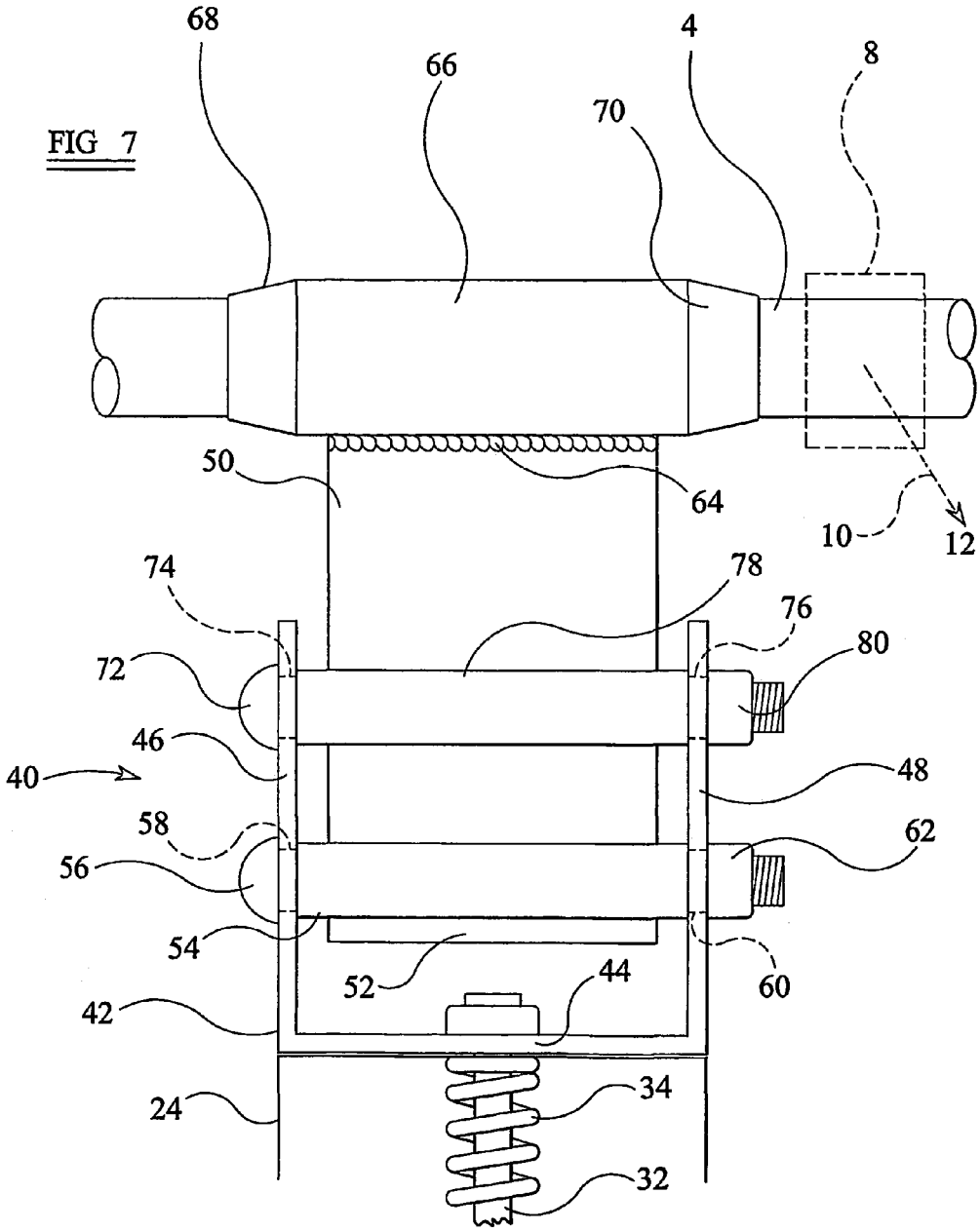
FIG. 7 is a detailed plan view of the intermediate bracket assembly incorporated in the assembly of FIG. 6.

As will now be described with reference to FIGS. 7, 8 and 9, the intermediate bracket assembly 40 may be constructed such that in itself it incorporates dynamic load absorbing means.

The intermediate bracket assembly 40 comprises base means 42 of substantially U-shaped form, having a base portion 44 arranged to be secured to the bracket means 24 by the spring-loaded mechanism comprising the nut and bolt assembly 32 and compression spring 34. The base portion 44 also has a pair of spaced-apart flange portions 46, 48 dependant therefrom. The base means 42 is suitably constructed of stainless steel.

An arm means 50 of substantially rectangular plate form, and suitably of stainless steel, has a first end 52 provided with a first hollow substantially cylindrical component 54, which is secured thereto or integral therewith.

A stainless steel bolt 56 passes through apertures 58, 60 in the flange portions 46, 48 of the base means 42 and through the hollow cylindrical component 54 at the first end 52 of the arm means 50. The bolt 56 is threaded and is secured in place by a threaded nut 62.

The arm means 50 is arranged with its first end 52 pivotable about the bolt 56.

The arm means 50 has a second end 64 provided with a second hollow substantially cylindrical component 66 secured thereto or integral therewith. The horizontal lifeline cable 4 is slotted through the component 66. The component 66 has tapered opposite ends 68, 70 to facilitate traversal of the component 66 by the safety line attachment device 8.

A shear pin 72, comprising a plastics material such as nylon, passes through apertures 74, 76 in the flange portions 46, 48 of the base means 42 and through a third hollow substantially cylindrical component 78 secured to, or integral with, the arm means 50 at a region intermediate the first and second ends 52, 64 of the arm means 50. The shear pin 72 is threaded to receive a threaded nut 80.

Figure 8:
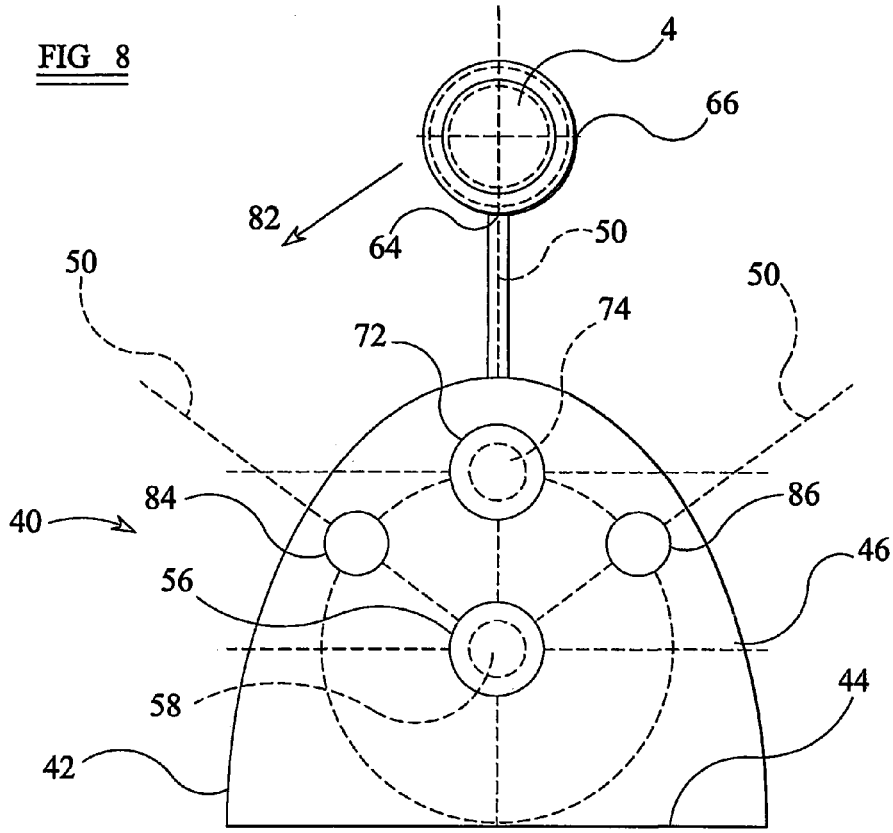
FIG. 8 is a side view of the intermediate bracket assembly of FIG. 7.

As shown in FIG. 8, the arm means 50 is secured by the shear pin in a first angular disposition relative to the base means 42.

If a dynamic load is applied to the cable 4 at or near the component 66 at the second end 64 of the arm means 50, in a downwards direction as shown by arrow 82, such dynamic load causes shearing or breakage of the shear pin 72. Such dynamic load results from the person 12 accidentally falling when secured to the cable 4 by the safety line 10 and attachment device 8.

Figure 9:
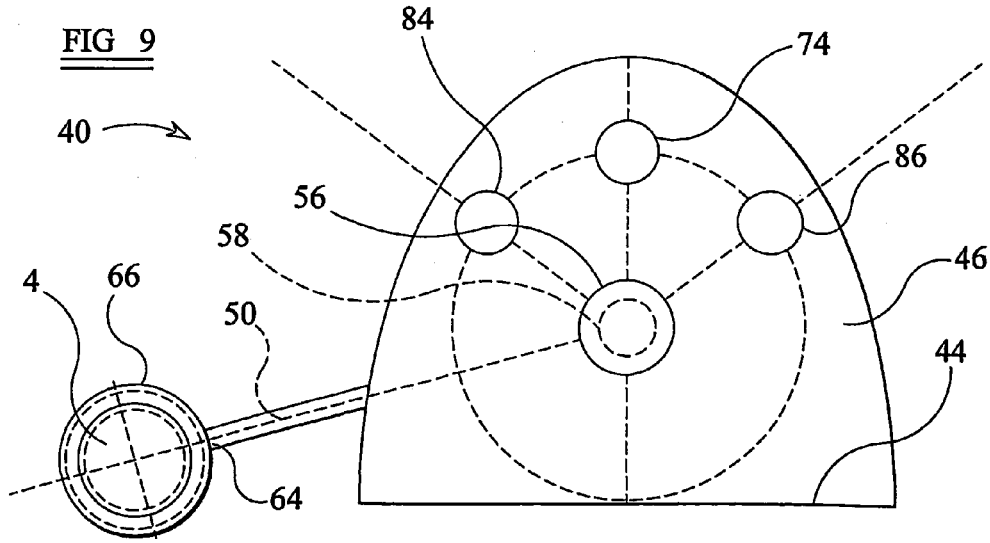
FIG. 9 is a side view of the intermediate bracket assembly of FIG. 7 after shearing of a shear pin therein.

When shearing or breakage of the shear pin 72 occurs, the arm means 50 pivots about its first end 52 on the bolt 56 and assumes a second angular disposition relative to the base means 42 as shown in FIG. 9.

The shear pin 72 operates to absorb the applied dynamic load and further prevents damage from occurring to the top of the roof 6 (FIG. 6) to which the supporting bracket assembly 2A, incorporating the intermediate bracket assembly 40, is secured.

With such an arrangement of supporting bracket assembly 2A, absorption of dynamic loads therefore occurs in three stages. In the first stage, shearing of the shear pin 72 occurs. In the second stage, the bracket means 24 pivots against its frictional restraint. In the third stage, compression of the spring 34 in the spring-loaded mechanism 32, 34 occurs.

In order to accommodate a variety of attachment angles of the supporting bracket assembly 2A on the top of the roof 6, the arm means 50 of the intermediate bracket assembly 40 can be secured by the shear pin 72 in alternative first angular dispositions relative to the base means 42. This is achieved by providing further apertures 84, 86 in the flange portion 46 of the base means 42, which cooperate with corresponding apertures (not shown) in the flange portion 48 and which can selectively receive the shear pin 72.

After experiencing dynamic loading, the intermediate bracket assembly 40 can be readily restored for further operation by simply installing a new shear pin 72.

Furthermore, after such dynamic loading, the supporting bracket assembly 2, 2A is fully restored for further operation by returning the bracket means 24 to its upstanding first position 36 (FIG. 4).

The invention claimed is:

1. A horizontal lifeline system comprising a horizontal lifeline cable (4) and a supporting bracket assembly supporting the cable (4), the assembly comprising: a base plate (14) secured to a structure (6); bracket means (24) secured to the base plate and adapted for frictionally restrained pivotability with respect to the base plate; and holding means (28, 40) supporting the cable (4) and secured to the bracket means (24), wherein the holding means (28, 40) is secured to the bracket means (24) by way of a spring-loaded mechanism (32, 34), the arrangement being such that dynamic loading of the cable (4) results in pivoting of the bracket means (24), against frictional restraint, from a first position (36) into a second position (38) and, in the second position, tensions the holding means (28, 40) for the cable against spring force of the spring-loaded mechanism (32, 34).

2. A system as claimed in claim 1, wherein the holding means (28, 40) for the cable (4) is secured to the bracket means (24) by means of an assembly of a nut and bolt (32) and a compression spring (34).

3. A system as claimed in claim 1, wherein the bracket means (24) is substantially upstanding on the base plate (14) in the first position (36) and substantially laterally disposed with respect to the base plate (14) in the second position (38).

4. A system as claimed in claim 1, wherein the base plate (14) is provided with a transverse cross member (20) underlying the bracket means (24).

5. A system as claimed in claim 4, wherein the bracket means (24) is disposed in contact with the cross member (20) in the second position (38).

6. A system as claimed in claim 1, wherein the base plate (14) is provided with a pair of upstanding lugs (22) to which the bracket means (24) is secured.

7. A system as claimed claim 1, wherein the bracket means (24) is secured to the base plate (14) by means of a pair of nut and bolt assemblies (26) incorporating one or more friction washers.

8. A system as claimed in claim 1, wherein the holding means (28) for the cable (4) is an end bracket (30) to which is securable an end of the cable.

9. A system as claimed in claim 1, wherein the holding means (40) for the cable is an intermediate bracket assembly for supporting the cable (4) intermediate ends of the cable.

10. A system as claimed in claim 9, wherein the intermediate bracket assembly (40) incorporates dynamic load absorbing means and comprises: base means (42) secured to the bracket means (24); arm means (50) having a first end (52) thereof provided with means (56) for pivotably securing it to the base means (42) and a second end (64) thereof adapted to receive the cable (4); at least one shear pin (72) secured to the base means (42) and arranged to support the arm means (50) at a region thereof intermediate the first and second ends (52, 64) thereof and in a first angular disposition relative to the base means (42), the at least one shear pin (72) being adapted to shear when the supporting bracket assembly is secured to the structure (6) and a predetermined downwardly-directed load is applied directly or indirectly to the cable (4) at or near the second end (64) of the arm means (50), whereby the arm means pivots downwardly about the first end (52) thereof and assumes a second angular disposition relative to the base means (42).

11. A system as claimed in claim 10, wherein the at least one shear pin (72) is secured to the base means (42) at a selected one of a plurality of positions whereby the first angular disposition of the arm means (50) relative to the base means may be varied.

12. A system as claimed in claim 10, wherein the base means (42) is of substantially U-shaped form having a base portion (44) arranged to be secured to the bracket means (24) and a pair of spaced-apart flange portions (46, 48) dependant therefrom, the first end (52) of the arm means (50) being pivotably secured to the flange portions and the shear pin (72) being secured at a predetermined position between the flange portions.

13. A system as claimed in claim 12, wherein the flange portions (46, 48) are provided with at least one pair of opposed cooperating apertures (74, 76) for securably receiving the at least one shear pin (72).

14. A system as claimed in claim 12, herein the flange portions (46, 48) are provided with a pair of opposed cooperating apertures (58, 60) which receive the means (56) for pivotably securing the first end (52) of the arm means (56) thereto.

15. A system as claimed in claim 10, wherein the at least one shear pin (72) comprises a plastics material.

16. A system as claimed in claim 10, wherein the at least one shear pin (72) is in the form of a threaded bolt provided with a threaded nut (80).

17. A system as claimed in claim 10, wherein the first end (52) of the arm means (50) is pivotably secured to the base means (42) by means selected from a pin and a bolt (56).

18. A system as claimed in claim 17, wherein the bolt (56) is threaded and provided with a threaded nut (62).

19. A system as claimed in claim 17 or 18, wherein the first end (52) of the arm means (50) is provided with a first hollow substantially cylindrical component (54) through which the pin or bolt (56) passes.

20. A system as claimed in claim 10, wherein the second end (64) of the arm means (50) is provided with a second hollow substantially cylindrical component (66) through which the cable (4) is arranged to pass.

21. A system as claimed in claim 20, wherein the second substantially cylindrical component (66) is externally tapered at opposite ends (68, 70) thereof, such as to facilitate traversal of the intermediate bracket assembly by an attachment device (8) which may be slidably secured to the cable (4) and connected to a safety line extending from a person working on the structure.

22. A system as claimed in claim 10, wherein the arm means (50) is provided, at the region intermediate the first and second ends (50, 64) thereof, with a third hollow substantially cylindrical component (78) through which the shear pin (72) is arranged to pass.

23. A system as claimed in claim 10, wherein the arm means (50) is of plate form.

24. A supporting bracket assembly for a horizontal lifeline cable (4), the assembly comprising: a base plate (14) for securing to a structure (6); bracket means (24) secured to the base plate and adapted for frictionally restrained pivotability with respect to the base plate; and an intermediate bracket assembly (40) for supporting the cable (4) intermediate the ends of the cable, the intermediate bracket assembly being secured to the bracket means (24), wherein the intermediate bracket assembly (40) is secured to the bracket means (24) by way of a spring-loaded mechanism (32, 34), the arrangement being such that dynamic loading of the cable (4) results in pivoting of the bracket means (24), against frictional restraint, from a first position (36) into a second position (38) and, in the second position, tensions the intermediate bracket assembly (40) for the cable against spring force of the spring-loaded mechanism (32, 34), and wherein the intermediate bracket assembly (40) incorporates dynamic load absorbing means and comprises: base means (42) secured to the bracket means (24); arm means (50) having a first end (52) thereof provided with means (56) for pivotably securing the arm means to the base means (42) and a second end (64) thereof adapted to receive the cable (4); at least one shear pin (72) secured to the base means (42) and arranged to support the arm means (50) at a region thereof intermediate the first and second ends (52, 64) thereof and in a first angular disposition relative to the base means (48), the at least one shear pin (72) being adapted to shear when the supporting bracket assembly is secured to the structure (6) and a predetermined downwardly-directed load is applied directly or indirectly to the cable (4) at or near the second end (64) of the arm means (50), whereby the arm means pivots downwardly about the first end (52) thereof and assumes a second angular disposition relative to the base means (42).

25. An assembly as claimed in claim 24, wherein the at least one shear pin (72) is secured to the base means (42) at a selected one of a plurality of positions whereby the first angular disposition of the arm means (50) relative to the base means may be varied.

26. An assembly as claimed in claim 24, wherein the base means (42) is of substantially U-shaped form having a base portion (44) arranged to be secured to the bracket means (24) and a pair of spaced-apart flange portions (46, 48) dependant therefrom, the first end (52) of the arm means (50) being pivotably secured to the flange portions and the shear pin (72) being secured at a predetermined position between the flange portions.

27. An assembly as claimed in claim 24, wherein the first end (52) of the arm means (50) is pivotably secured to the base means (42) by means selected from a pin and a bolt (56).

28. An assembly as claimed in claim 27, wherein the first end (52) of the arm means (50) is provided with a first hollow substantially cylindrical component (54) through which the pin or bolt (56) passes.

29. An assembly as claimed in claim 24, wherein the second end (64) of the arm means (50) is provided with a second hollow substantially cylindrical component (66) through which the cable (4) is arrange to pass.

30. An assembly as claimed in claim 24, wherein the arm means (50) is provided, at the region intermedilate the first and second ends (52, 64) thereof, with a third hollow substantially cylindrical component (78) through which the shear pin (72) is arrange to pass.

* * * * *